US008573805B2

(12) United States Patent
Leung et al.

(10) Patent No.: US 8,573,805 B2
(45) Date of Patent: Nov. 5, 2013

(54) MOSAIC LED TILE

(75) Inventors: Tean Sue-Anne Leung, Happy Valley (HK); John Patrick Kieran, Sheung Wan (HK)

(73) Assignee: Huizhou Light Engine Ltd., Huizhou (CN)

( * ) Notice: Subject to any disclaimer, the term of this patent is extended or adjusted under 35 U.S.C. 154(b) by 334 days.

(21) Appl. No.: 13/007,324

(22) Filed: Jan. 14, 2011

(65) Prior Publication Data

US 2012/0182739 A1 Jul. 19, 2012

(51) Int. Cl.
*F21S 4/00* (2006.01)

(52) U.S. Cl.
USPC ..... 362/249.02; 362/249.06

(58) Field of Classification Search
USPC ..... 362/249.02, 249.06, 237, 240, 244, 362/652–659; 439/544
See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 5,390,093 | A * | 2/1995 | Himeno et al. | 362/249.06 |
| 8,066,403 | B2 * | 11/2011 | Sanfilippo et al. | 362/219 |
| 8,287,150 | B2 * | 10/2012 | Schaefer et al. | 362/249.02 |
| 2009/0033243 | A1 | 2/2009 | Gater | |
| 2009/0212721 | A1 | 8/2009 | Maruyama | |
| 2009/0310066 | A1 * | 12/2009 | Schuch et al. | 349/69 |

FOREIGN PATENT DOCUMENTS

| | | | |
|---|---|---|---|
| CN | 101494938 | A | 7/2009 |
| CN | 101516148 | | 8/2009 |
| CN | 201345755 | Y | 11/2009 |

* cited by examiner

*Primary Examiner* — Bao Q Truong
(74) *Attorney, Agent, or Firm* — Schiff Hardin LLP

(57) ABSTRACT

A lighting apparatus comprises one or more LED modules. Each LED module comprises: an upper housing having an array of raised portions capable of transmitting light therethrough; a PCB layer having LEDs mounted thereon, respective ones of the LEDs being mounted so as to positionally correspond to respective ones of the raised portions; and a lower housing, the lower housing and the upper housing sandwiching the PCB layer so as to permit light emitted by the LEDs to be emitted out of the upper housing.

6 Claims, 17 Drawing Sheets

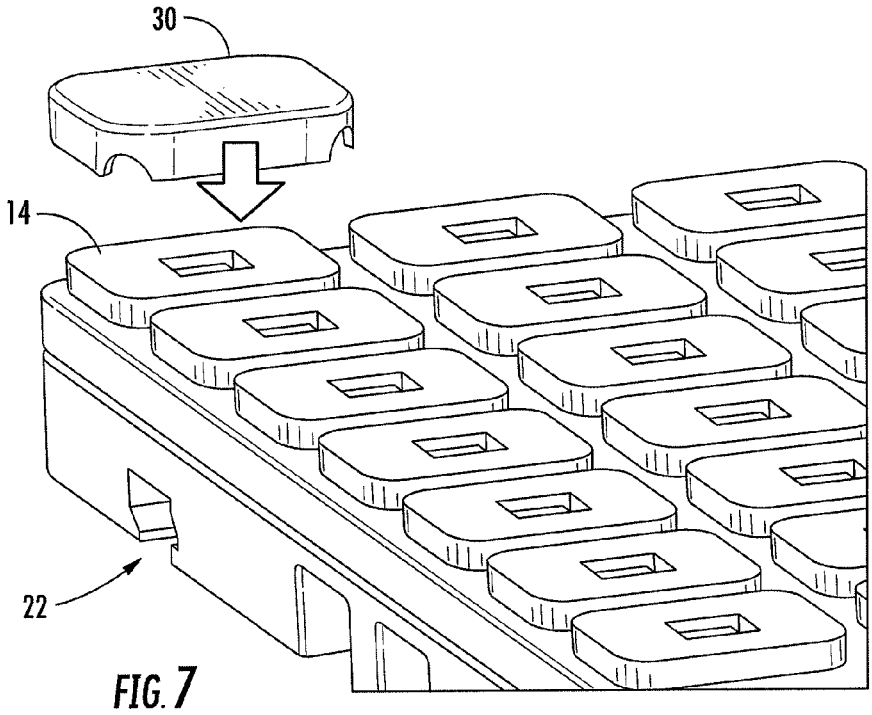
FIG. 7
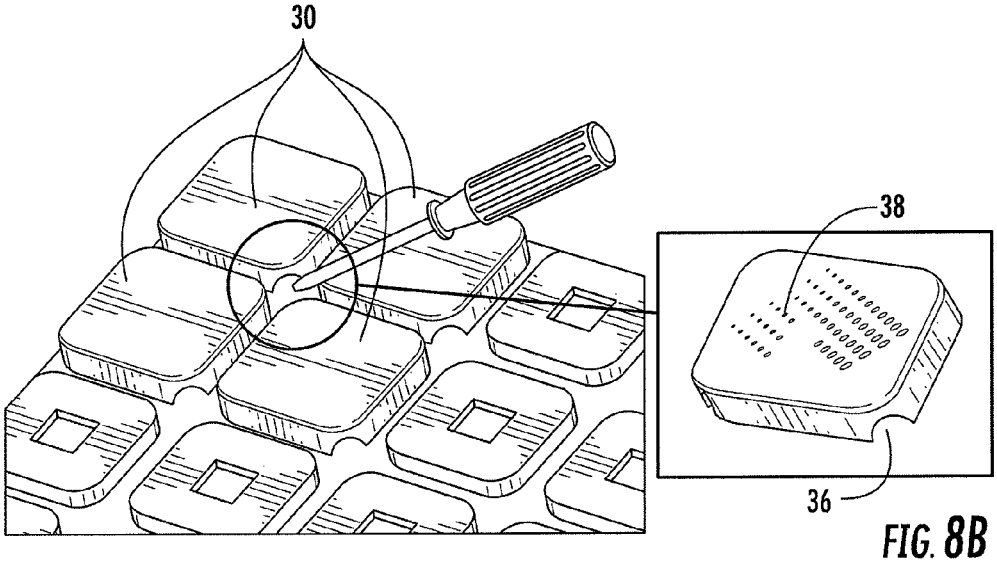
FIG. 8A
FIG. 8B

MOSAIC LED TILE

BACKGROUND OF THE INVENTION

The present invention relates to back or side lit lighting apparatuses used for lighting, for examples in signage.

Conventionally, back lit units are fixed position units that do not permit changing of the configuration after installation. That is, once the back lit unit is configured, the display is fixed, which makes any changes to, for example, a sign or display to be quite difficult.

BRIEF SUMMARY OF THE INVENTION

In accordance with a first aspect of the present invention, a lighting apparatus comprises one or more LED modules. Each LED module comprises: an upper housing having an array of raised portions capable of transmitting light therethrough; a PCB layer having LEDs mounted thereon, respective ones of the LEDs being mounted so as to positionally correspond to respective ones of the raised portions; and a lower housing, the lower housing and the upper housing sandwiching the PCB layer so as to permit light emitted by the LEDs to be emitted out of the upper housing.

In another aspect, the lower housing of each of the one or more LED modules includes one or more connection openings that facilitate connection together of a plurality of LED modules together to form a mosaic of LED modules.

In another aspect, at least one of the one or more connection openings is operable to receive electrical signals and/or power.

In another aspect, each raised portion includes an aperture to permit light from respective LEDs to pass through respective raised portions.

In another aspect, the lighting apparatus further comprises a connector configured to make a snap fit connection between connection openings of adjacent LED modules when a plurality of LED modules are connected together to form a mosaic.

In another aspect, each connector includes plural male portions adapted to mate with corresponding female portions provided in the connection openings.

In another aspect, the lighting apparatus further comprises one or more tiles configured to snap fit over one or more of the raised portions.

In another aspect, each of the one or more tiles is configured to modify or pass the light emitted from the upper housing.

In accordance with a second aspect of the present invention, a lighting apparatus comprises one or more LED modules. Each LED module comprises: an upper housing having an upper surface and at least one edge having a slot provided therein; a substantially planar light leading lens having at least one side edge formed in a direction perpendicular to a plane of the light leading lens, the light leading lens being configured so as to mount on the top surface of the upper housing and to lead light received at the at least one side edge; at least one PCB strip having LEDs mounted thereon, the at least one PCB strip, when the LED module is assembled, protruding through the slot so that the LEDs are on the same level as the at least one edge of the light leading lens; and a lower housing comprising at least one slit provided at an outer edge of the lower housing.

In another aspect, each LED module further comprises a substantially planar transparent tile molding provided above the light leading lens, the transparent tile molding being configured to contact an upper surface of the light leading lens and having a plurality of raised portions operable to direct light from the light leading lens in a direction substantially perpendicular to the plane of the light leading lens.

In another aspect, the lower housing of each of the one or more LED modules includes one or more connection openings that facilitate connection together of a plurality of LED modules together to form a mosaic of LED modules.

In another aspect, at least one of the one or more connection openings is operable to receive electrical signals and/or power.

In another aspect, the lighting apparatus further comprises one or more tiles configured to snap fit over one or more of the raised portions.

In another aspect, each of the one or more tiles is configured to modify or pass the light emitted from the transparent tile molding.

In another aspect, the lighting apparatus further comprises a connector configured to make a snap fit connection between connection openings of adjacent LED modules when a plurality of LED modules are connected together to form the mosaic of LED modules.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which:

FIG. 7 illustrates how a plug tile is used in an LED module in accordance with an embodiment of the present invention;

FIG. 8A illustrate plug tiles installed at portions of an LED module in accordance with an embodiment of the present invention, and how they can be removed;

FIG. 8B illustrates an example of a plug tile with painting on its surface;

DETAILED DESCRIPTION OF THE INVENTION

Figure 1A:
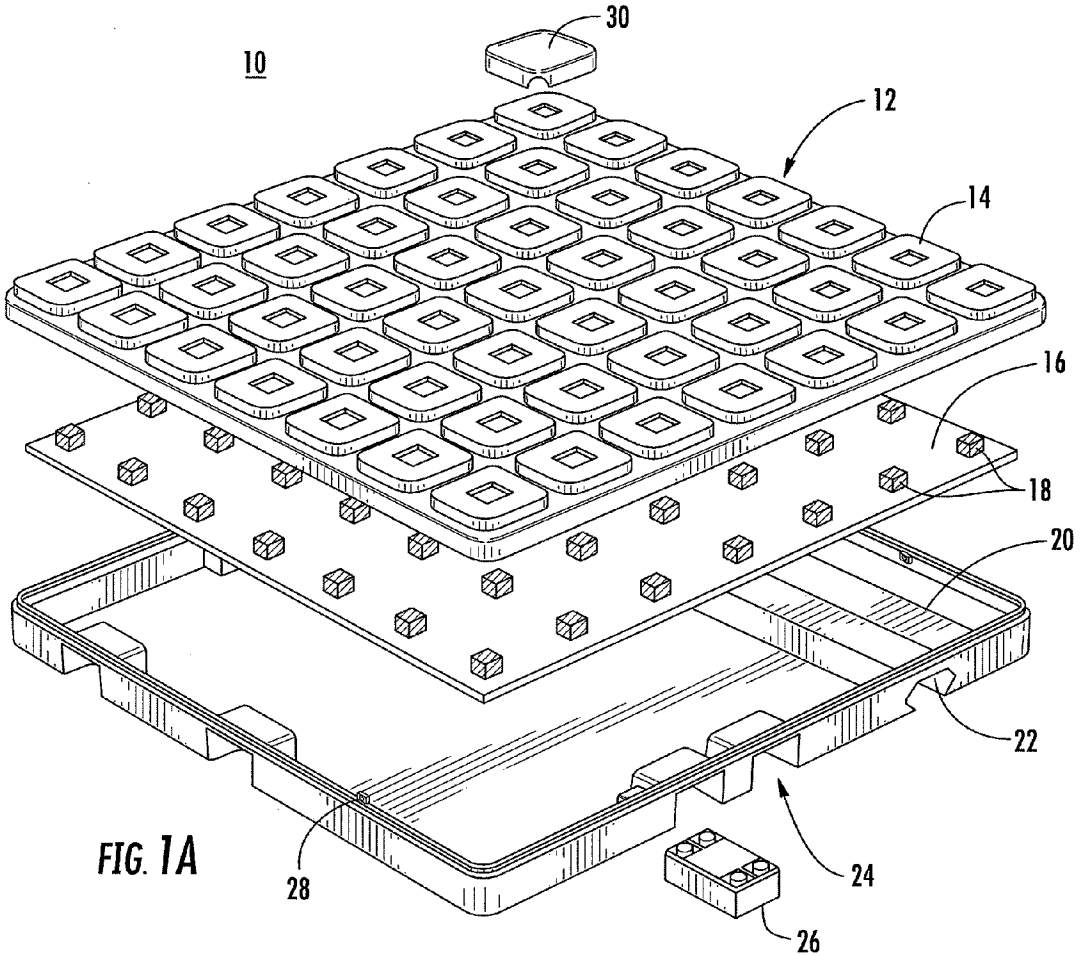
FIG. 1A is an exploded parts view of an individual LED module in accordance with an embodiment of the present invention.

FIGS. 1A-10C illustrate a first preferred embodiment of an LED module and mosaic of such modules, in accordance with an aspect of the present invention. As can be seen in the figures, an individual LED module 10 in accordance with the first embodiment of the present invention is formed of an upper housing 12, having an array of apertured raised areas 14, preferably integrally formed with the upper housing, for example by molding, a PCB layer 16, with an array of LEDs 18 mounted thereon, and a lower housing 20. In the illustrated embodiment, an array of 7×7 (i.e., 49) LEDs are laid out in an array on the PCB layer 16. An exemplary PCB layer could be, for example, a 150 mm×150 mm PCB with mounted LEDs on top, and circuitry for receiving signals and power on the other side, although the present invention is not limited to any particular dimensions or layout. As would be understood, the LED array in accordance with the present invention is not limited to any particular number.

The raised areas 14 of the upper housing 12 preferably each include an aperture in a central portion thereof. Preferably, in a back lit embodiment in which the LEDs 18 are sandwiched between the upper housing 12 and the lower housing 20, the LEDs are mounted on the PCB 16 and each LED 18 fits into the underside of the upper housing in an aperture, as can be seen in the cross-sectional view of FIG. 1B. This permits the light from the LEDs 18 to emanate from the top of the LED module 10, through the apertures. As can be seen clearly in FIG. 1C, for example, when viewed from the top, the LEDs 18 show through the apertures in each raised portion 14. The upper housing 12 and the lower housing 20 are each preferably formed of plastic or other moldable materials.

Tiles 30 can be applied to one or more of the raised portions 14 to modify the visual appearance of the light from the apertures. For example, if the tiles 30 are frosted, they can be used to diffuse the light coming from the aperture. Further, as can be seen in FIG. 8B, the tiles can have painting on the surface, which can be seen by a viewer of, for example, a screen made up of a number of LED modules 10. Also, tiles can be colored, to color the appearance of the light, clear, which will not change the color, or opaque, e.g., black, to block light from being emitted from one or more apertures covered by the tile. The manner of application can be seen, for example, in FIG. 7. The tiles 30 preferably are notched to allow for easy removal using, for example, a screwdriver, as shown in FIG. 8A. The tiles 30 are preferably made of plastic.

Figure 9:
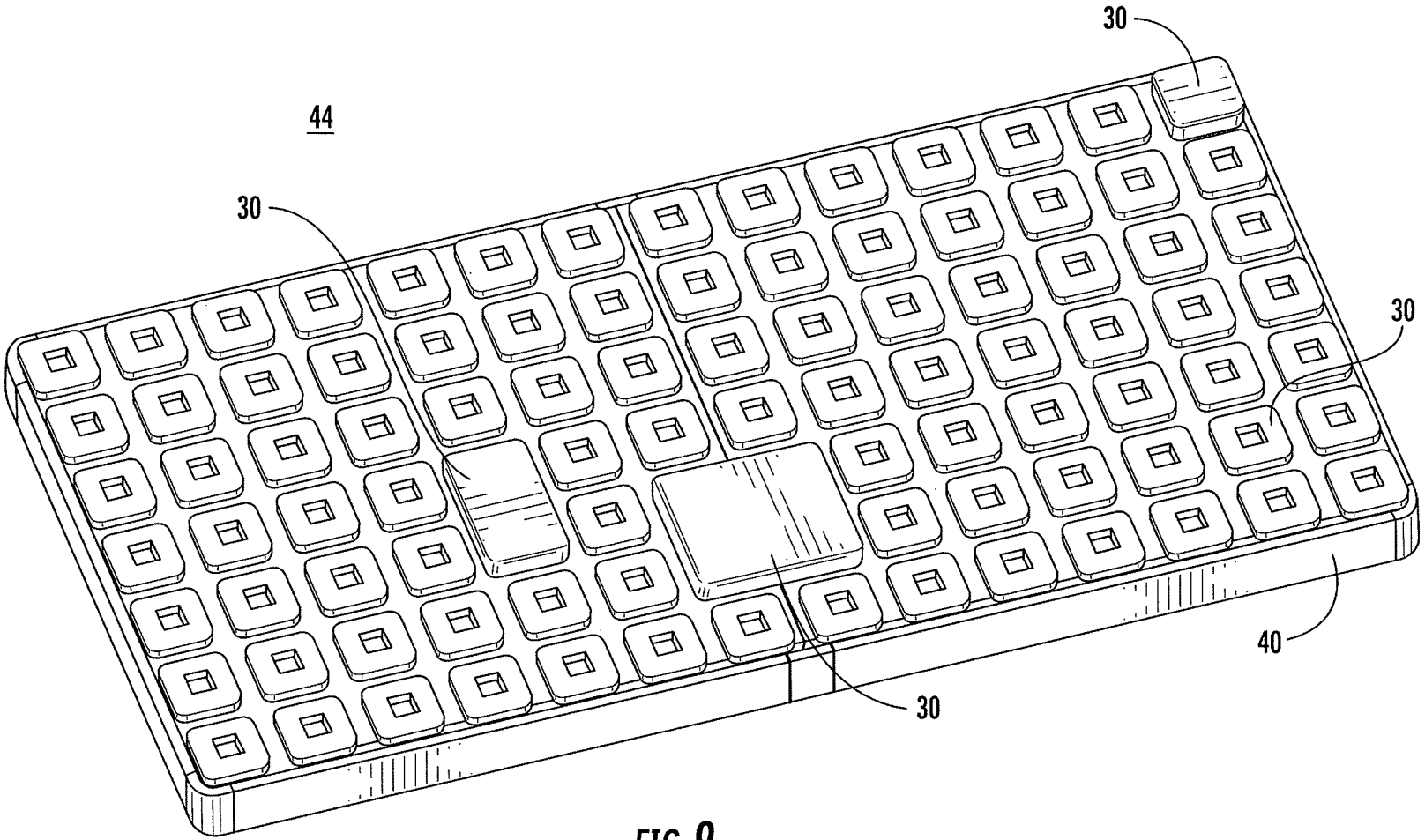
FIG. 9 shows a two module mosaic with multiple installed plug tiles and frame installed, in accordance with an embodiment of the present invention.

Combinations of sizes, colors and other characteristics of the tiles 30 allows for a large amount of variation in the appearance of the overall display mosaic. For example, as can be seen in FIG. 9, different size tiles can be used in a multi LED module (in this case a 2 LED module) mosaic 44. As shown in FIG. 9, in this example a 4×4 tile (i.e., a tile that covers a 4×4 group of raised portions 14) is used to overlap the edge between two adjacent LED modules. The use of the various kinds and sizes of tiles 30 provides the flexibility to have all the LEDs appear to the viewer to be lit, or only a subset of them to appear lit, depending on the type of tile or tiles used, whether the tiles are clear, semi-transparent, opaque, or with textures such as ripples. The tiles can also be asymmetrical and may provide for light at different angles.

The tiles are not limited to the shapes shown in the figures but may have any shape pleasing to the eye. In addition to various colors and transparencies, tiles could have different textures and/or a 3D visual effect. Tiles can also be formed with an optical design so as to give different light output, for example to as to change the projected shape of the light, for example an optical design that changes light usually projected as a round spot to projected light having different shapes such as a star, square, rectangle, oval or other shape.

Figure 1B:
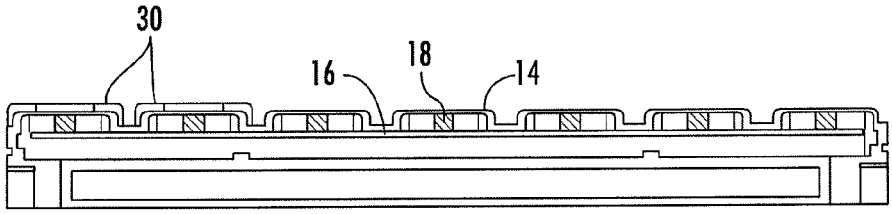
FIGS. 1B and 1C are side and top views, respectively, of the LED module shown in FIG. 1A.
Figure 1C:
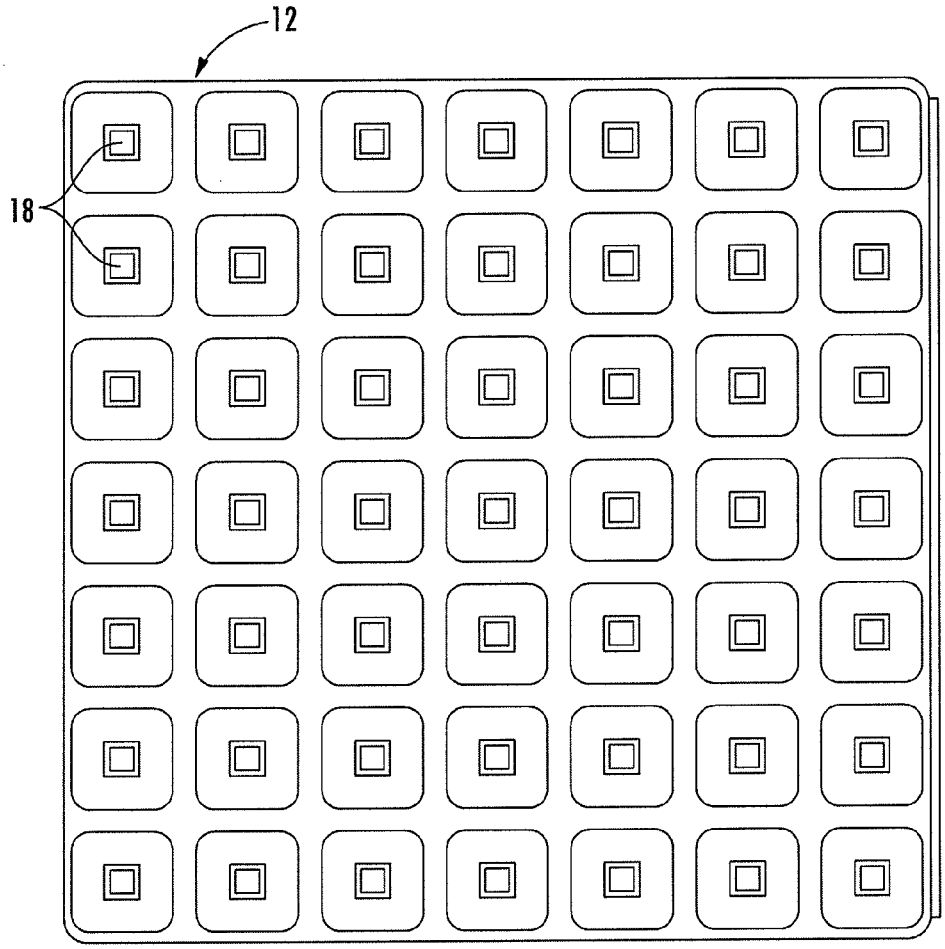
Figures 2A, 2B, 3:
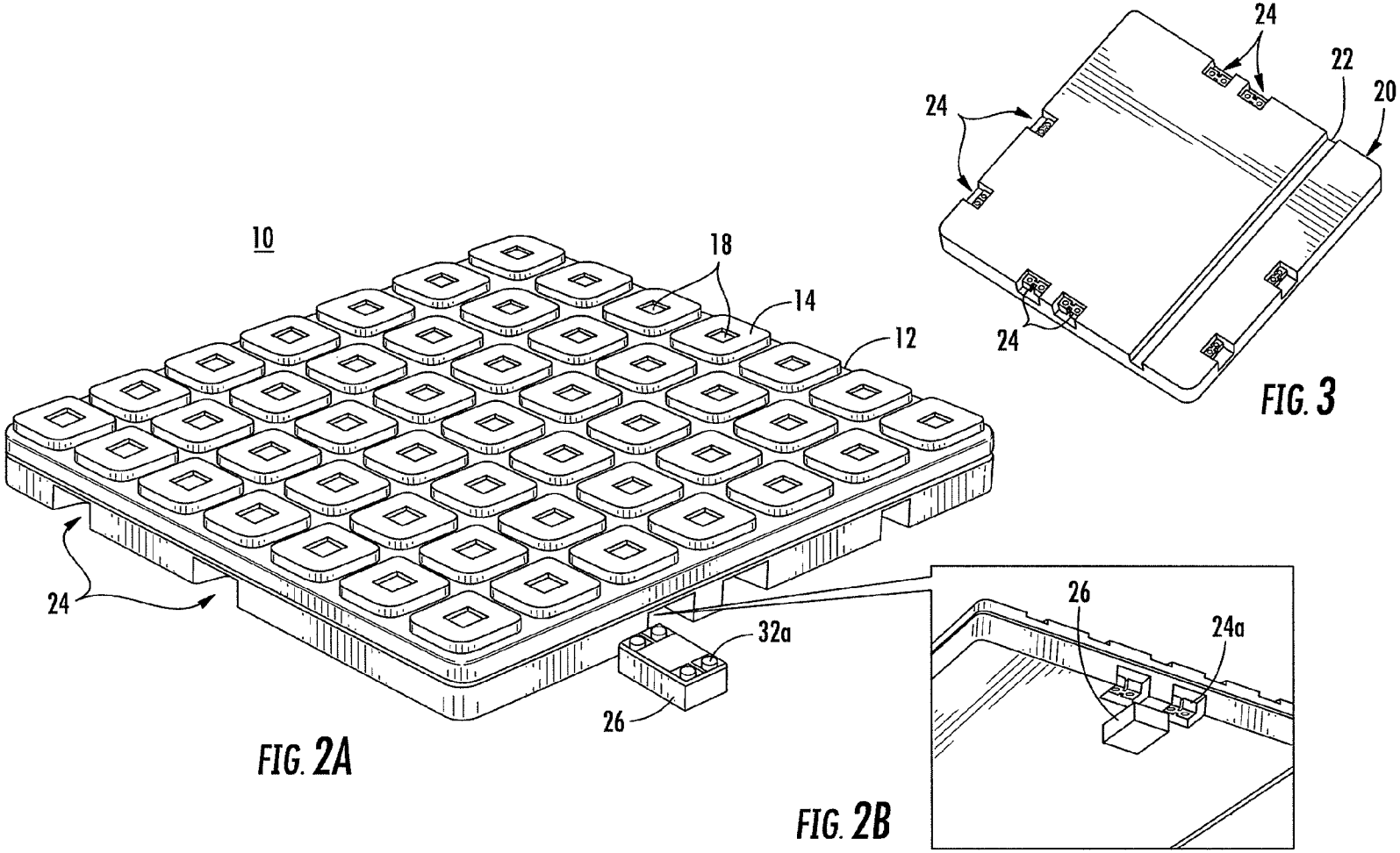
FIGS. 2A and 2B are perspective and magnified views, respectively, of an assembled individual LED module with a plug in connector, in accordance with an embodiment of the present invention.
FIG. 3 is a bottom perspective view of a lower housing of the LED module shown in FIG. 1A.

As shown, for example, in FIGS. 1A to 1C, an individual LED module 10 in accordance with a first embodiment provides a back lit module that is connectable, for example using connectors 26 inserted into one or more of connection openings/sockets 24 formed in the lower housing 20, to other LED modules, to form a mosaic, with each LED module acting as a tile in the mosaic. When connected together the mosaic forms a panel of a desired size.

An exemplary manner of connection with the connectors 26 is shown in FIGS. 2A-4A. As can be seen in those figures, the connectors 26 each include recessed male portions 26*a* which mate with female portions 24*a* in the connector indents 24 of two LED modules to be adjacently connected, to securely connect the two LED modules. This can be repeated in all four directions for each LED module to allow for mosaics of increasing size. The connectors 26 can be of two general types: one type which mechanically links two LED modules without passing electrical signals; and another (active) type that is a DC connector to interconnect the LED modules, e.g., for power and/or electrical signals. Typically no more than one active connector would be used on any one side of an LED module.

Figure 5B:
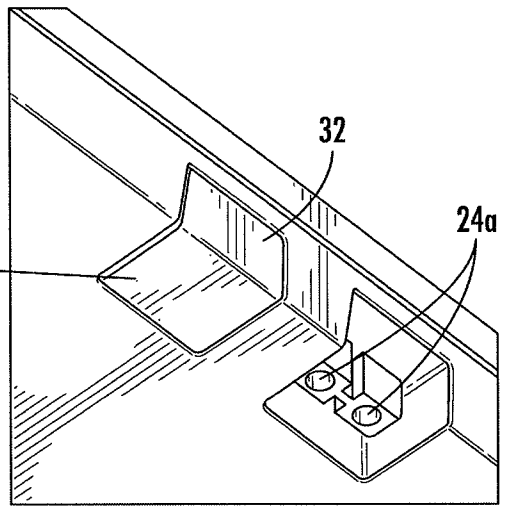
FIGS. 5A and 5B are views showing how an end cap is utilized to enclose a connector socket in an LED module in accordance with an embodiment of the present invention.
Figure 5A:
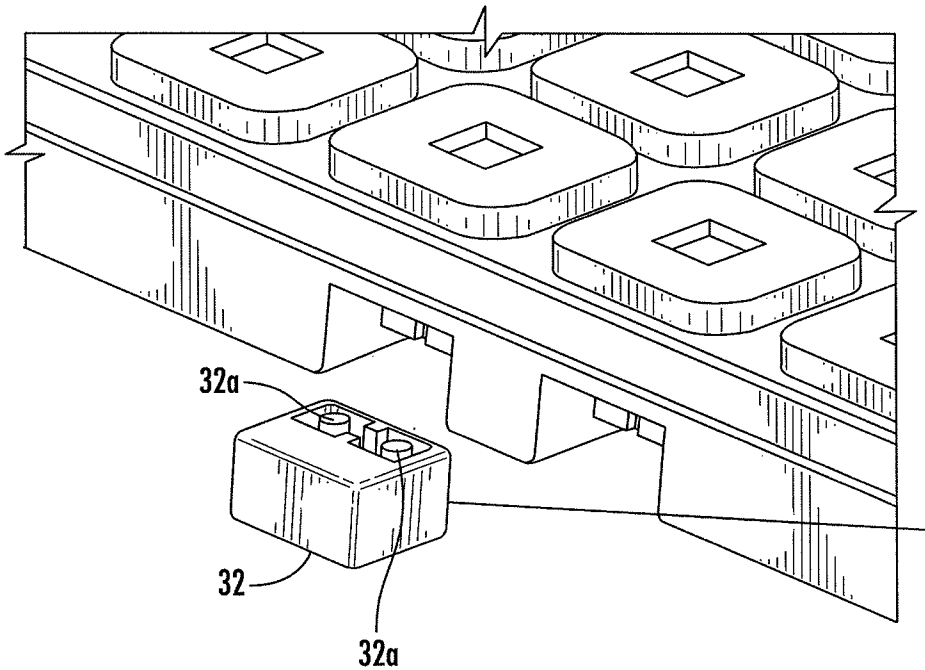

FIGS. 5A and 5B show an end cap 32 used to enclose an unused connection opening 24. To promote a secure connection with the connection opening 24, the end cap 32 is preferably formed so as to have male portions 32*a* that can mate with female portions 24*a* of the connection opening 24. The use of the end caps 32 may be advantageous, for example, at the outermost edges of the outer LED modules in a mosaic, or in any connection opening that is unused for any reason. The end cap 32 does not pass any signals or power and simply encloses any unused connection openings.

Figure 6:
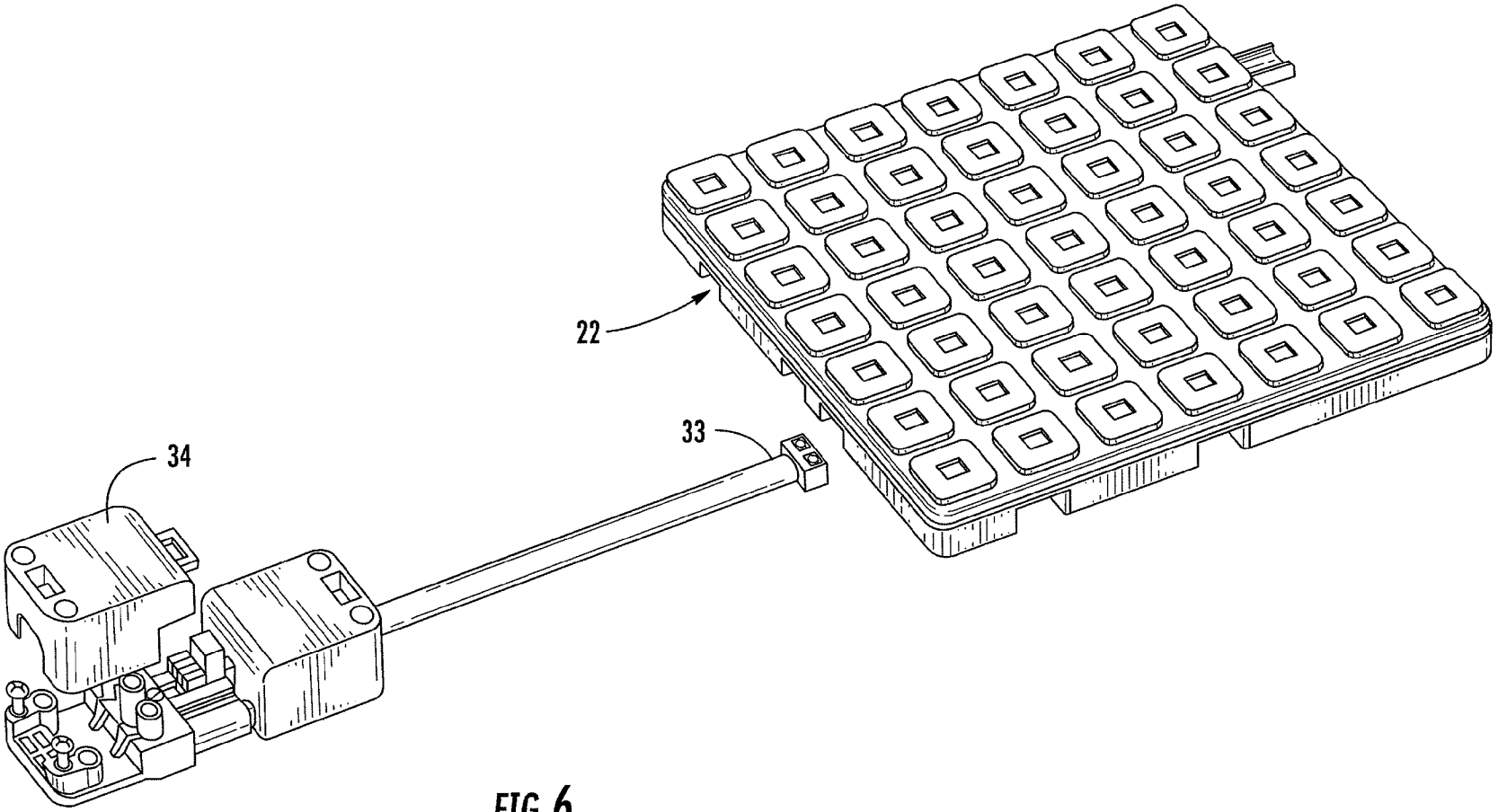
FIG. 6 shows an LED module and a power supply connector in accordance with an embodiment of the present invention.

FIG. 6 shows a power supply connector 33 that can be used to supply electrical signals/power to the PCB layer 16 and the LEDs 18. The power supply connector is preferably an AC/DC power connector to supply power from a power source, such as a wall outlet, to the PCB layer. In this particular embodiment, the power supply connector 33 is supplied by wiring box 34, which can be in the form of a plug or other connector to a source of power/signals. Signals from the power supply connector 33, which would typically be DC, are supplied, for example, to circuitry in the PCB layer 16, for driving and powering the LEDs.

Figure 10B:
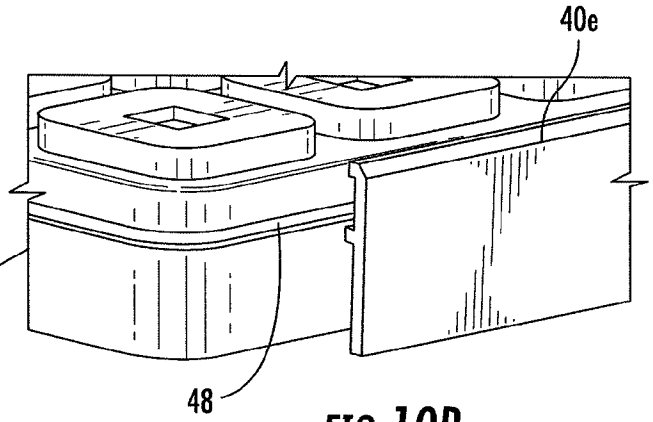
FIG. 10B is a magnified view showing how a part of the frame is attached to an edge of an LED module, in accordance with an embodiment of the present invention.
Figure 10A:
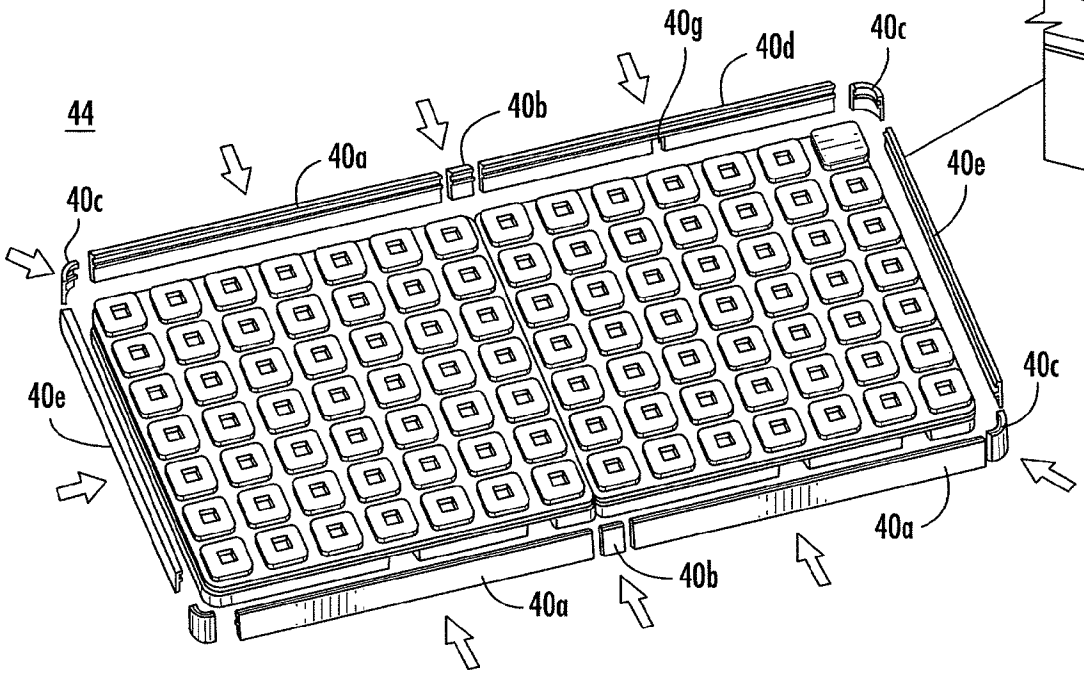
FIG. 10A is a view of a two LED module mosaic showing the individual parts of the frame in an exploded parts view of the frame.
Figure 10C:
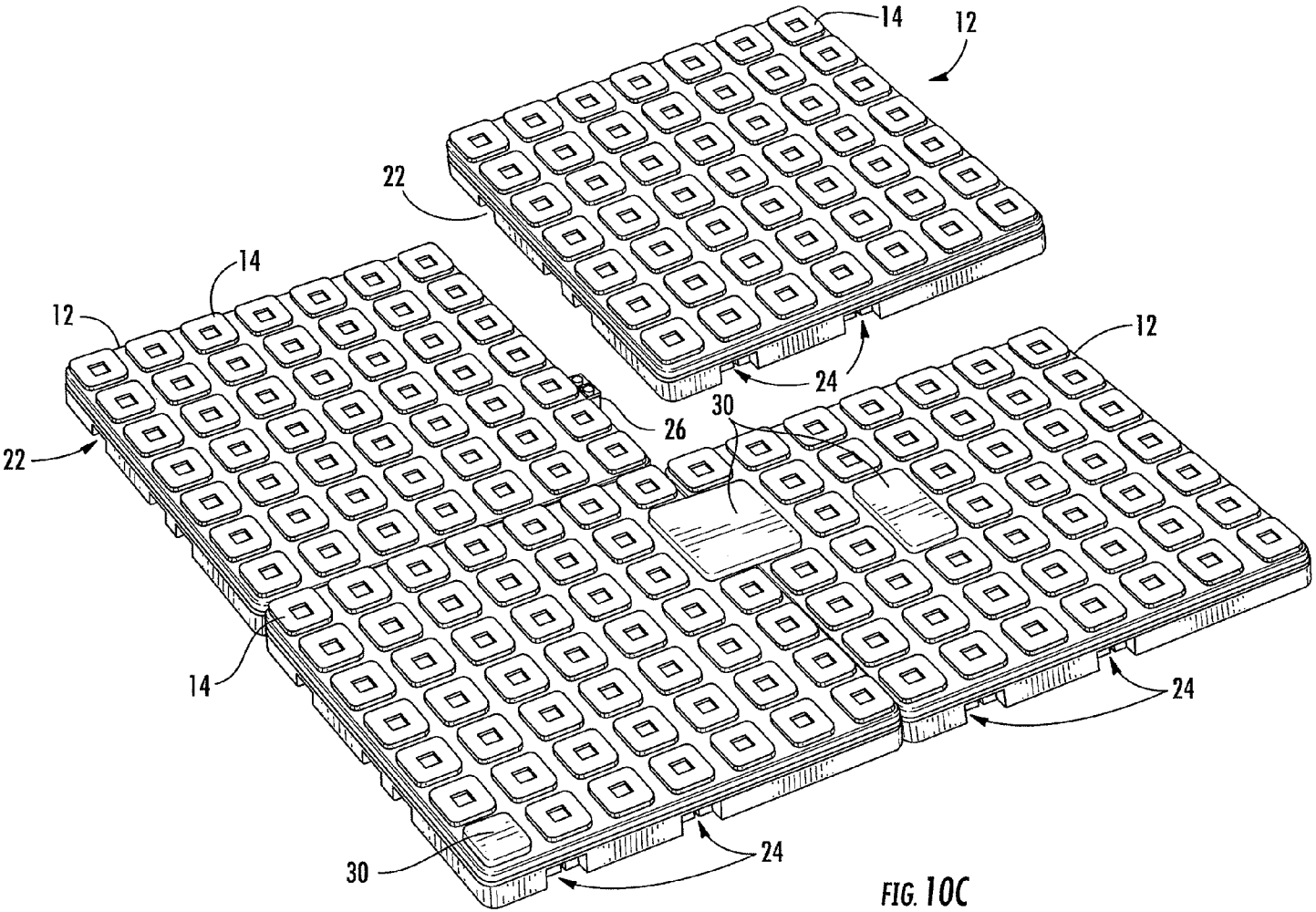
FIG. 10C is a view of a four LED module mosaic, in accordance with an embodiment of the present invention.
Figure 11B:
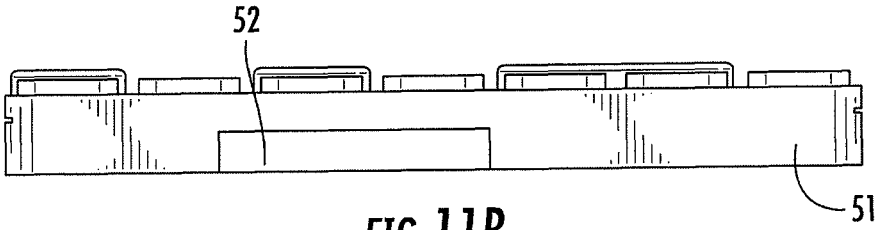
FIGS. 11A and 11B are plan and side views, respectively, of an LED module in accordance with a second embodiment of the present invention.
Figure 11A:
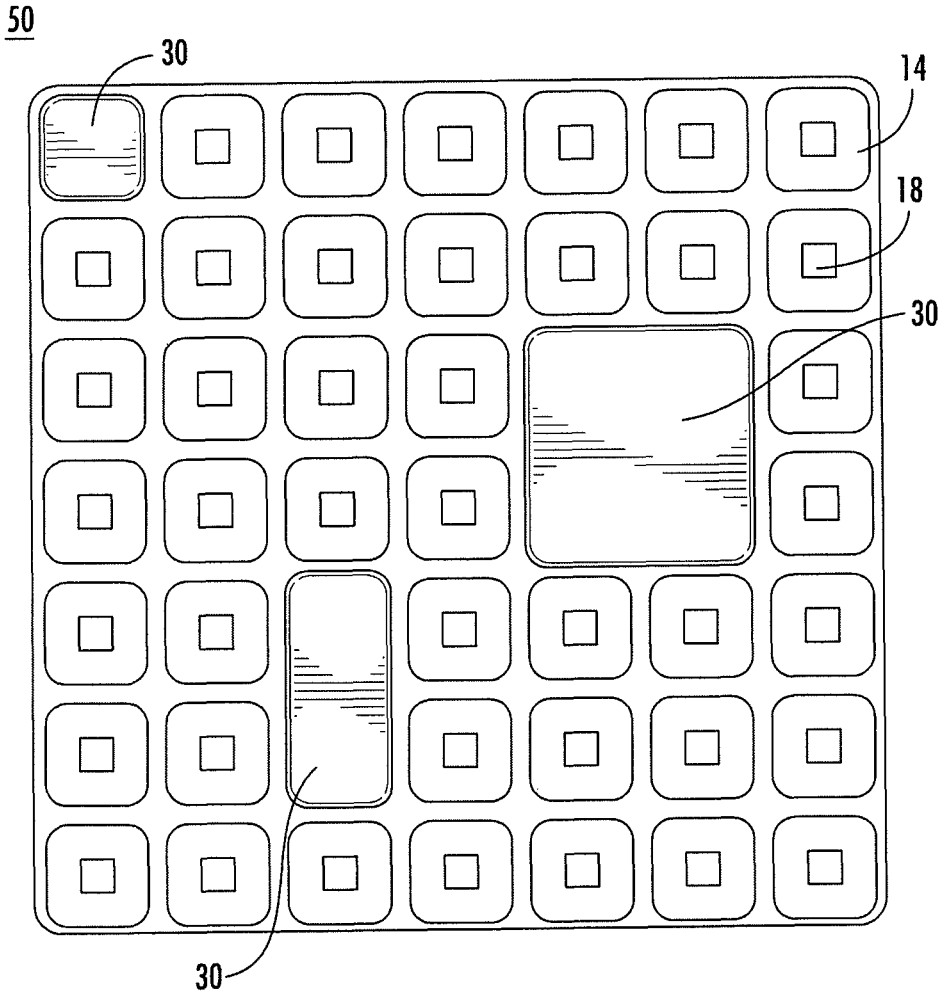
Figure 12A:
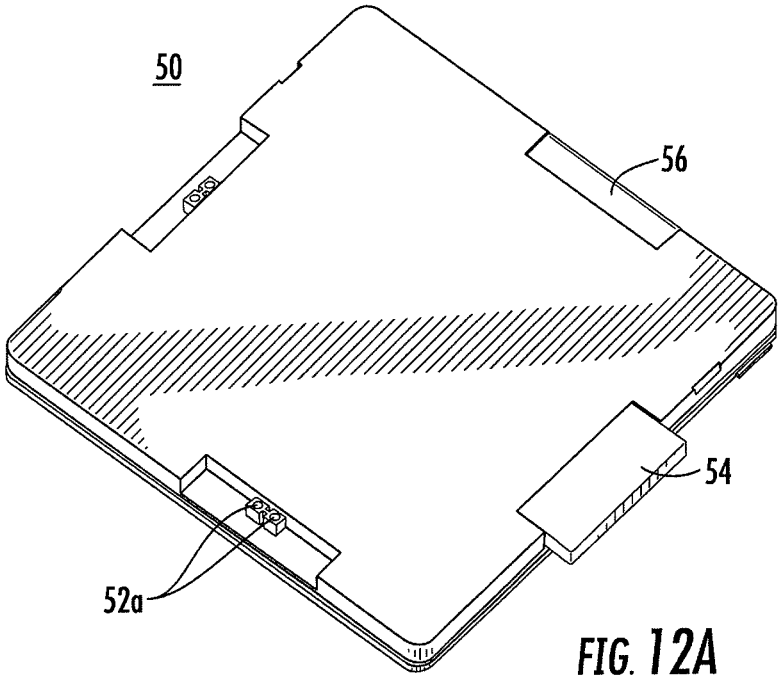
FIGS. 12A and 12B are bottom and top perspective views, respectively, of an LED module with end cap and connector in accordance with the second embodiment.
Figure 12B:
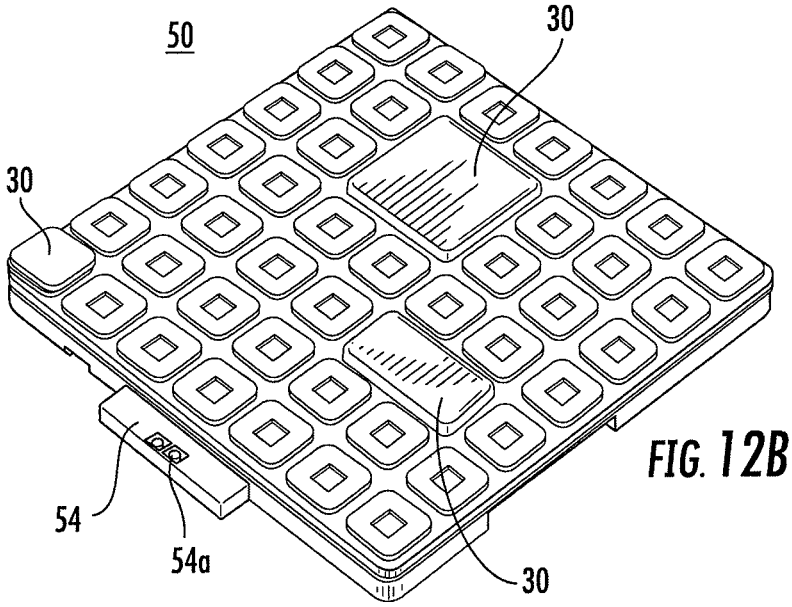

As can be seen, for example, in FIGS. 9, 10A and 10B, a frame 40 can be snap fitted around the periphery of the assembled mosaic 44. In the illustrated embodiment, frame 40 consists of frame elements 40*a* to 40*e* that form different shaped elements each having a shape to conform to the shape of the periphery. The frame 40 shown in the figures is used in conjunction with a 2×1 mosaic. However, the frame elements can easily form a frame around mosaics of any size, using various combinations of the frame elements. The frame 40 protects the edges of the assembled mosaic and provides strength to the connection. In addition, the frame functions to provide a pleasing aesthetic appearance by hiding the wires and connectors from being seen. As can be seen most clearly in FIG. 10B each frame element has a portion on its inner surface that can be snapped into the track 48 that is provided around each LED module. As shown in FIG. 10A, frame element 40*d* includes a notch 40*g* that allows the power supply connector to couple with one of the LED modules to supply power to the panel (mosaic) formed by the connected LED modules. The wires will preferably run through the bottom of the lower housing.

Figure 4A:
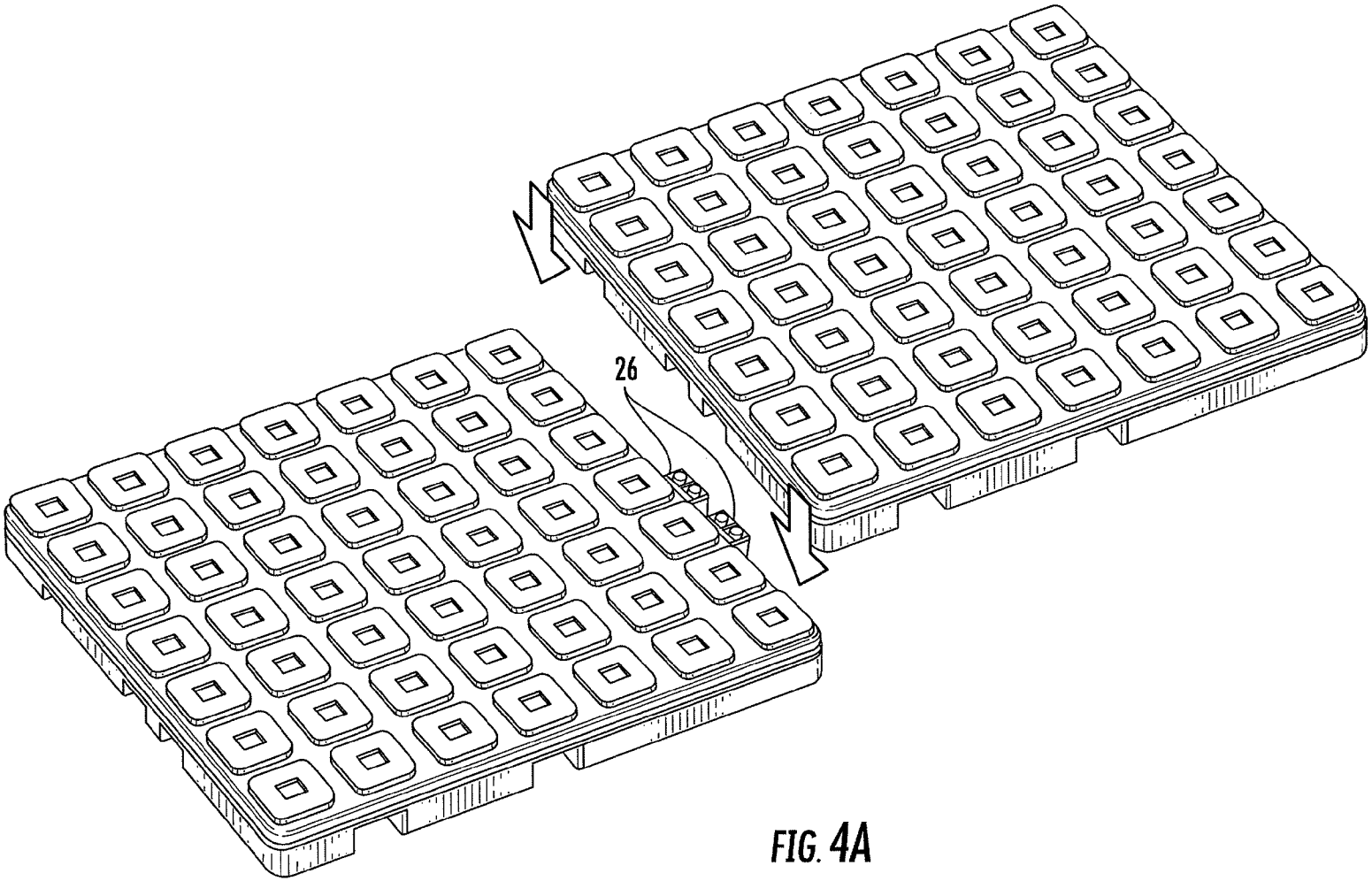
FIG. 4A shows two LED modules and a manner of connecting the LED modules to one another to form a multi-module mosaic, in accordance with an embodiment of the present invention.
Figure 4B:
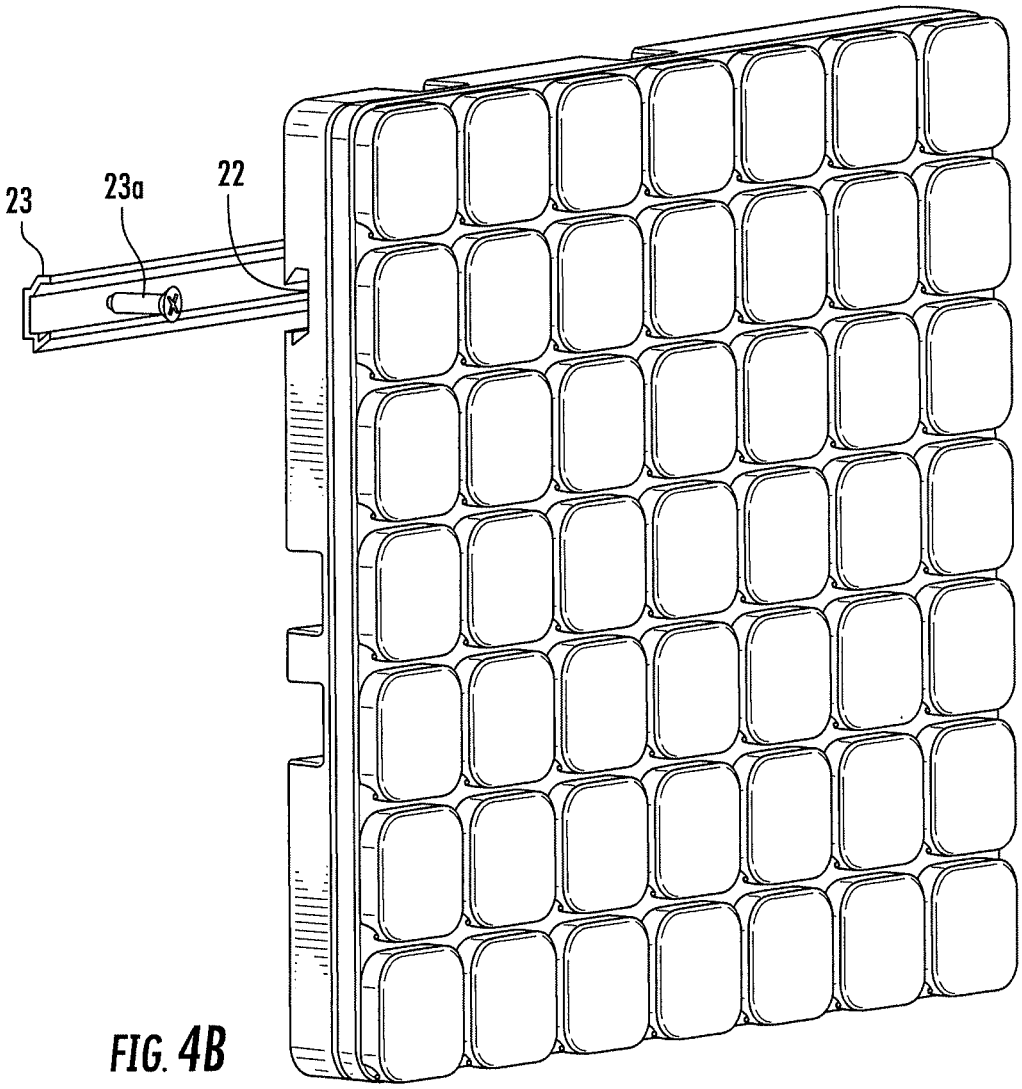
FIGS. 4B and 4C are views showing one manner of securing an LED module to a wall.
Figure 4C:
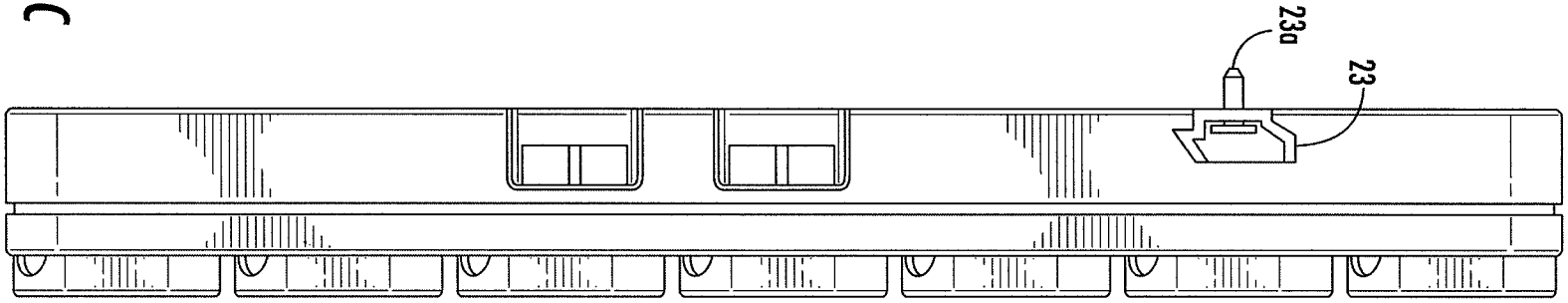

For use in mounting a mosaic, or an individual LED module, the lower housing 20 also preferably is configured/formed so as to have a channel track 22, which permits mounting of the LED module, alone or in connection with other LED modules 10, e.g., on a wall or other surface. As can be seen in FIGS. 4B and 4C, a channel 23 can be first affixed to a wall or other mounting surface by, for example, a screw 23*a*. This channel can be used, in conjunction with the channel track 22, to slidably, or snapably mount one or more LED modules to the wall.

The lower housing 20 preferably is formed so as to have a buckle 28 that allows the lower housing 20 to snap fit together with the upper housing 12 in assembling the LED module 10. Once assembled, electrical signals and power connections to the sandwiched PCB layer 16 can be made by means of connectors that may be connected via the connection openings 24.

Each LED module has connective elements from the connector to the PCB layer 16 to apply the necessary signals for driving and powering the LEDs 18. In the event of a failure of PCB layer 16 in the module, the PCB layer 16 may be replaced, eliminating the need to replace the upper and lower housing if such failure occurs. This also permits a single LED module to be replaced, or the PCB layer 16 of that module to be replaced, in the event of a failure, without having to replace an entire panel, resulting in significant savings in maintenance costs over time.

Another embodiment of a back lit LED module, also connectable to form a mosaic of such modules, is shown in FIGS. 11A-12B. As illustrated in those figures, an LED module 50 in accordance with a second aspect of the present invention is substantially the same in operation as the LED module 10 discussed above, but includes a differently shaped lower housing 51 and different manner of connection to other LED modules. In particular, in this embodiment, a larger connection opening/socket 52 is provided in the lower housing, with female portions 52*a*. Female portions 52*a* are molded so as to mate with a connector 54 and male portions 54*a* of the connector 54. As in the first embodiment, the connector 54 permits two LED modules 50 to be snapped together to form a mosaic of such LED modules. In this second embodiment, the connector is somewhat wider and in effect integrates two connectors of the first embodiment into one. As in the first embodiment, a PCB layer 16 (not visible in the figure), including LEDs 18, is sandwiched between the upper housing, which is the same as in the first embodiment, and the lower housing 51. An end cap 56, shown in FIG. 12A can be used to cover an unused connection opening. As in the first embodiment, at least one of the LED modules in a mosaic formed by the LED modules needs to be connected to a power supply, such as by a power supply connector discussed above.

Just as in the first embodiment, in the second embodiment the use of tiles 30 provides the ability to design a pleasing light display in the same manner as described above with reference to the first embodiment, and the identical description is not repeated here. Also, just as in the first embodiment, the LED modules can be connected together to form a mosaic of such modules, in this case using the larger connection opening 52 and connectors 54. As in the first embodiment, at least on of the LED modules will be connected to the power supply unit, but the connectors will not be seen by providing, for example, a frame as shown above with reference to the first embodiment. Thus, in use, mosaics formed by tiling together LED modules of the second embodiment will look the same after assembly as mosaics formed by tiling together LED modules of the first embodiment.

While the first and second embodiments discussed above use a back lit configuration, in which individual LEDs 18 mounted on a PCB 16 are located behind each aperture of the upper housing, in the third embodiment, light is produced by side lighting using LED/PCB strips mounted at two sides of the LED module. This embodiment is illustrated in FIGS. 13A-14B.

An exemplary side lit LED module 60 in accordance with the third embodiment of the present invention is formed from a lower housing 68, PCB and LED strips 66, an upper housing 69, a light leading lens 70 and a transparent tile molding 62. The lower housing 68 is preferably molded or otherwise formed to have openings 52 which can accept connectors, end caps, or power supply connectors, as shown, for example, above with reference to the first and second embodiments. The lower housing 68 preferably is formed so as to include a channel track 72, which allows for mounting of the LED module 60, and a mosaic formed by plural LED modules 60, to, e.g., a wall or other surface.

Figure 13A:
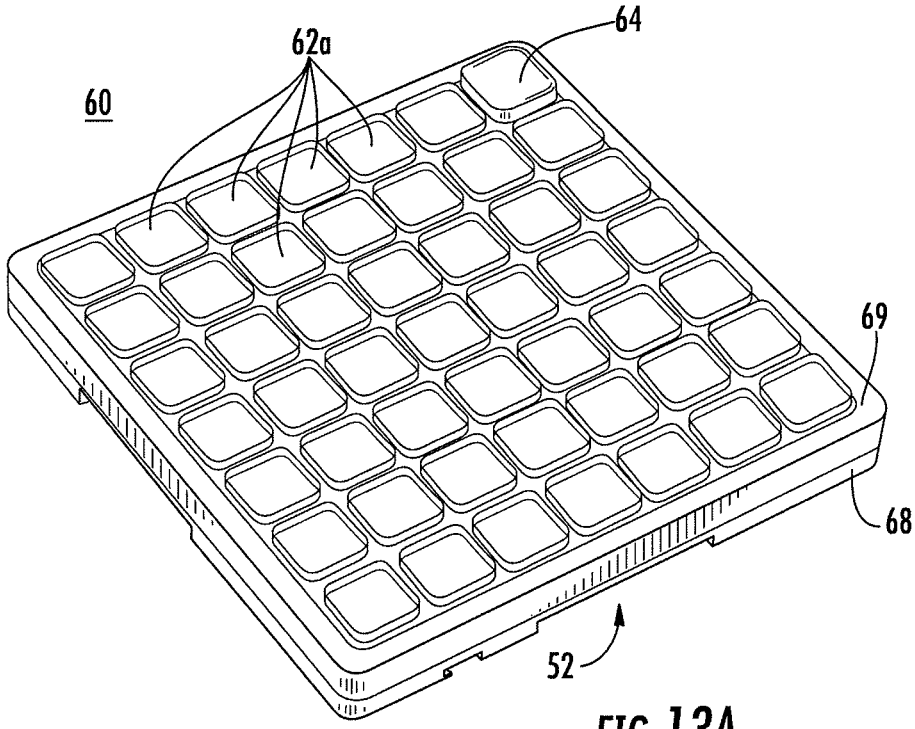
FIG. 13A is a top perspective view of an LED module in accordance with a side lit embodiment of the present invention.
Figure 13B:
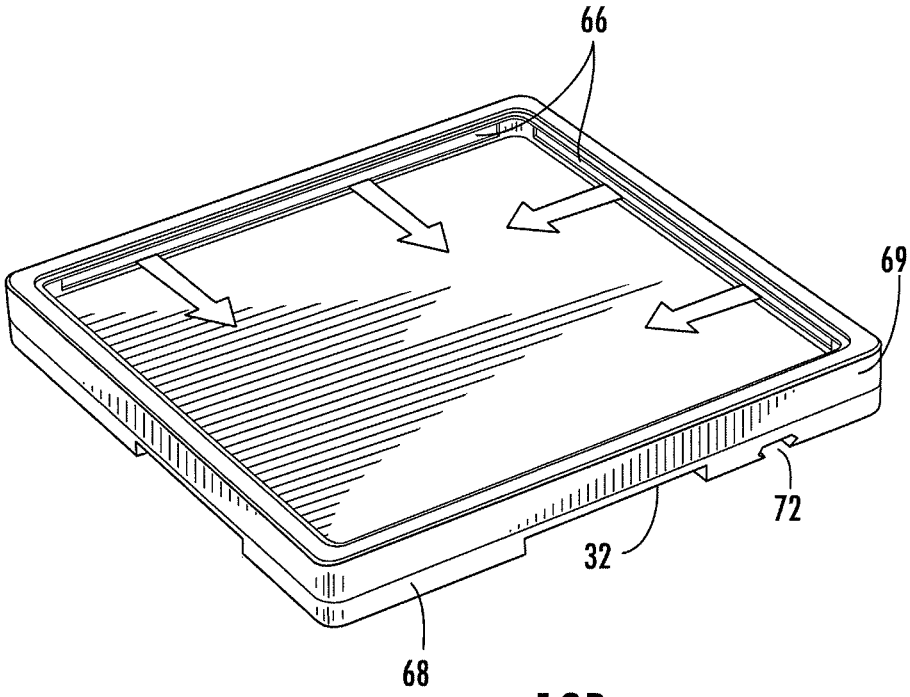
FIG. 13B is a view of an LED module in accordance with a side lit embodiment of the present invention with the transparent tile molding removed.
Figure 14A:
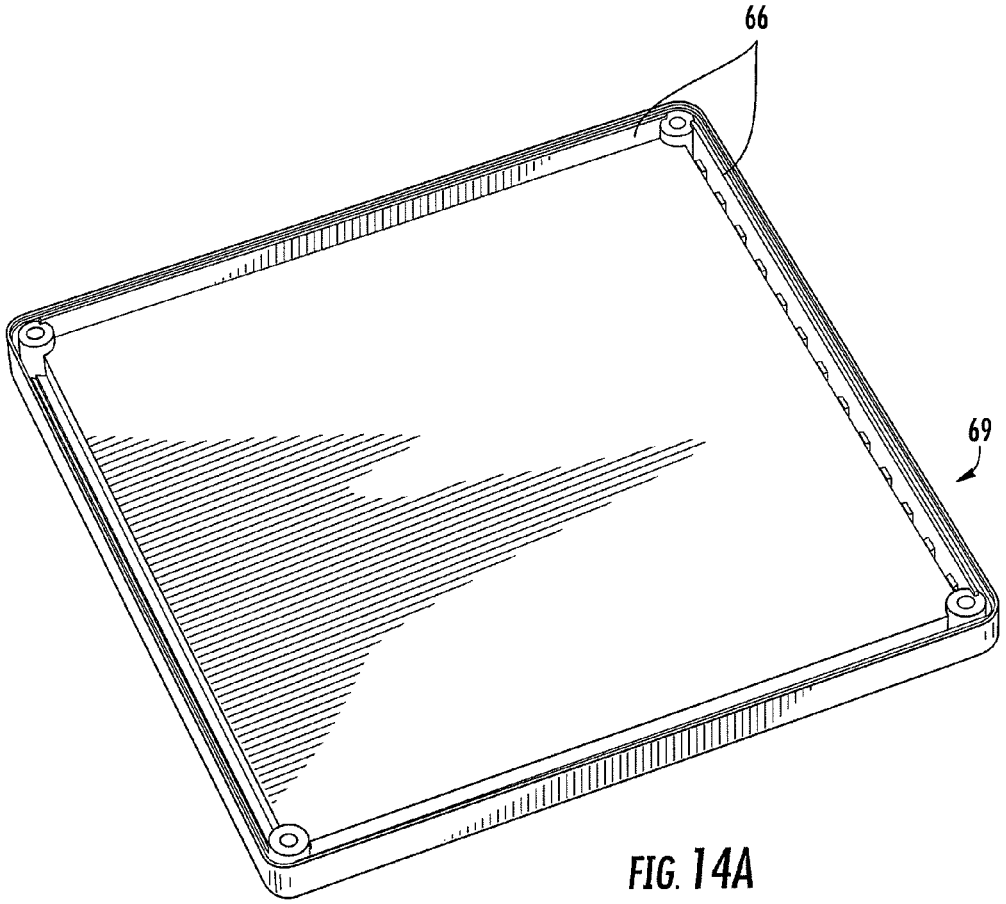
FIG. 14A is an underside view of the upper housing in accordance with a side lit embodiment, with the PCB and LED strips inserted into slots in the upper housing.
Figure 14B:
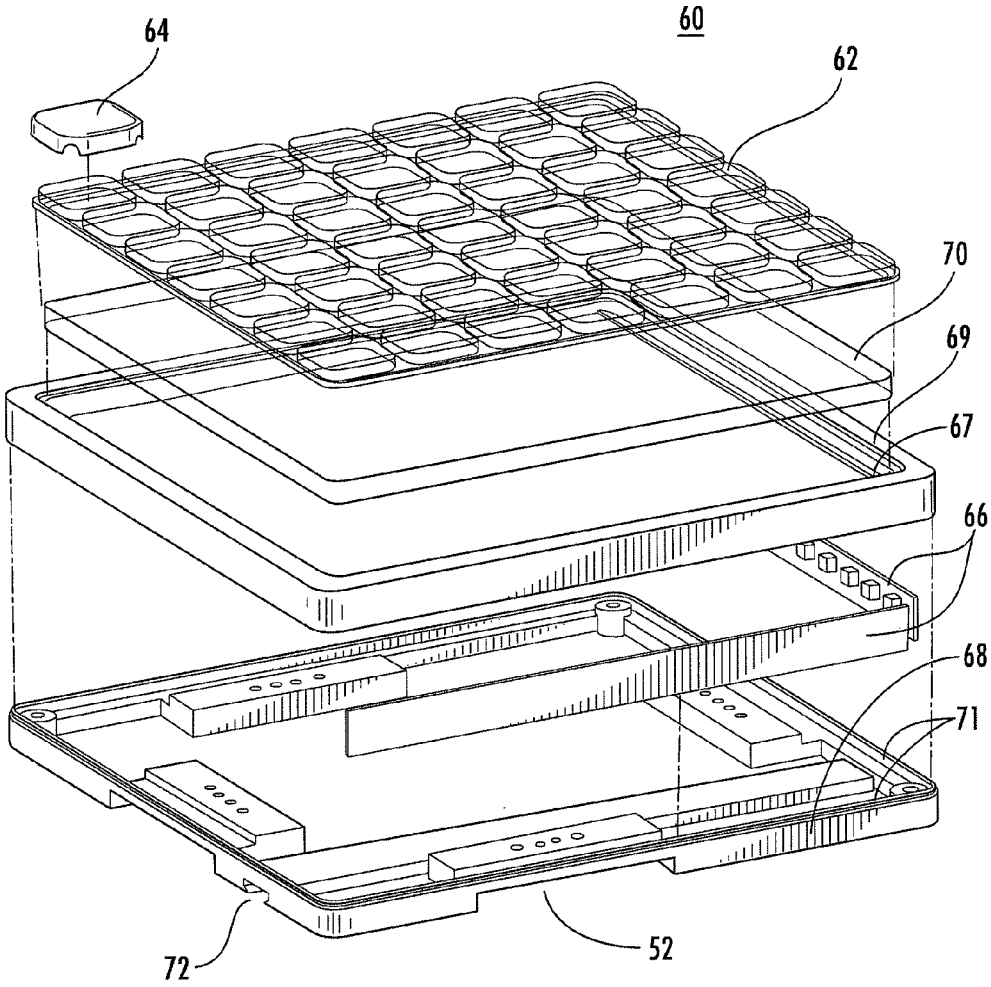
FIG. 14B is an exploded parts view of an LED module in accordance with a side lit embodiment of the present invention.

The lower housing 68 preferably includes slits 71 at two sides to guide the PCB and LED strips 66 and open slots 67 are provided in the upper housing 69 to allow the PCB and LED strips 66 to protrude to that the LEDs will be at the same level as the light leading lens 70 when the LED module 60 is assembled. FIG. 13A is a view of an assembled side lit LED module 60. FIG. 13B is a view of the side lit embodiment of the LED module but without the transparent tile molding 62, in order to show the direction of the light emitted from the LEDs. As can be seen from FIG. 13B, the light is emitted in a sideways direction along the plane of the LED module, as shown by the arrows. The light so emitted is then guided and diffused by the light leading lens 70, and, in conjunction with the transparent lens molding, is caused to be output out of the top of the LED module 60. FIG. 14A is an underside view of the upper housing 69 showing the PCB and LED strips 66 inserted into the slots 67 of the upper housing 68. FIG. 14B is an exploded parts view showing the abovementioned component elements of the side lit embodiment.

Although the third embodiment is shown employing a lower housing having wider connection openings, similar to those shown with reference to the second embodiment discussed above, the lower housing in the side lit embodiment can also utilize connection openings and connectors as described above with regard to the first embodiment, as would be appreciated by one of skill in the art. In either case, the connection openings can provide electrical power and/or signals for the LEDs, including from the power supply unit discussed above, and from connectors attached to the connection openings.

Preferably, in the side lit embodiment, the light leading lens 70 conducts light from the side mounted PCB and LED strips 66 in the direction of the arrows shown in FIG. 13B. Transparent tile molding 62, is formed so as to have raised portions 62*a*, which permit application of tiles 64. Just as in the first and second embodiments, the tiles 64 allow parts of the light to be blocked, colored, or otherwise modified, to provide a desired display effect for signage and the like.

Although not shown in the figures illustrative of the second and third embodiments, a frame 40 is preferably used in mosaics formed in accordance with the second and third embodiments at the periphery of a mosaic of LED modules according to these embodiments in just the same manner shown in FIGS. 9-10B. In these embodiments the frame has the same functions as in the first embodiment discussed above.

The above embodiments advantageously permit multiple LED modules to be tiled together to form larger light emitting displays, for example, for forming signs. The ability to replace individual LED modules from such a mosaic, and the ability to use the snap on tiles to modify the light emitted from the LED modules, provides great flexibility in creating and modifying such displays without the need to manufacture a entire new display each time a new design or light pattern is required.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A lighting apparatus comprising one or more LED modules, each LED module comprising:

an upper housing having an array of raised portions capable of transmitting light therethrough;

a PCB layer having LEDs mounted thereon, respective ones of the LEDs being mounted so as to positionally correspond to respective ones of the raised portions;

a lower housing, the lower housing and the upper housing sandwiching the PCB layer so as to permit light emitted by the LEDs to be emitted out of the upper housing; and a connector configured to make a snap fit connection between connection openings of adjacent LED modules when a plurality of LED modules are connected together to form a mosaic, wherein the lower housing of each of the one or more LED modules includes one or more connection openings that facilitate connection together of a plurality of LED modules together to form a mosaic of LED modules.

2. The lighting apparatus according to claim 1, wherein at least one of the one or more connection openings is operable to receive electrical signals and/or power.

3. The lighting apparatus according to claim 1, wherein each raised portion includes an aperture to permit light from respective LEDs to pass through respective raised portions.

4. The lighting apparatus according to claim 1, wherein each connector includes plural male portions adapted to mate with corresponding female portions provided in the connection openings.

5. A lighting apparatus comprising one or more LED modules, each LED module comprising:

an upper housing having an array of raised portions capable of transmitting light therethrough;

a PCB layer having LEDs mounted thereon, respective ones of the LEDs being mounted so as to positionally correspond to respective ones of the raised portions;

a lower housing, the lower housing and the upper housing sandwiching the PCB layer so as to permit light emitted by the LEDs to be emitted out of the upper housing; and one or more tiles configured to snap fit over one or more of the raised portions.

6. The lighting apparatus according to claim 5, wherein each of the one or more tiles is configured to modify or pass the light emitted from the upper housing.

* * * * *